US009276303B2

(12) United States Patent
Chang et al.

(10) Patent No.: US 9,276,303 B2
(45) Date of Patent: Mar. 1, 2016

(54) MULTI-CHANNEL MODE CONVERTER AND ROTARY JOINT OPERATING WITH A SERIES OF TE OR TM MODE ELECTROMAGNETIC WAVE

(75) Inventors: Tsun-Hsu Chang, Hsinchu (TW); Nai-Ching Chen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 563 days.

(21) Appl. No.: 13/494,089

(22) Filed: Jun. 12, 2012

(65) Prior Publication Data

US 2013/0257563 A1 Oct. 3, 2013

(30) Foreign Application Priority Data

Mar. 27, 2012 (TW) ..... 101110559 A

(51) Int. Cl.

| | |
|---|---|
| ***H01P 1/161*** | (2006.01) |
| ***H01P 1/06*** | (2006.01) |
| ***H01P 5/103*** | (2006.01) |
| ***H01P 5/12*** | (2006.01) |

(52) U.S. Cl.

CPC ..... *H01P 1/161* (2013.01); *H01P 1/069* (2013.01); *H01P 5/103* (2013.01); *H01P 5/12* (2013.01)

(58) Field of Classification Search

CPC ..... H01P 1/069; H01P 1/161; H01P 5/103; H01P 5/12

USPC ..... 333/21 R, 137, 256, 257, 261

See application file for complete search history.

(56) References Cited

U.S. PATENT DOCUMENTS

| | | | | |
|---|---|---|---|---|
| 5,442,329 | A * | 8/1995 | Ghosh et al. | 333/21 R |
| 2010/0123529 | A1 * | 5/2010 | Chang et al. | 333/21 R |

OTHER PUBLICATIONS

Nai-Ching Chen; Investigation of Coaxial TE01 Mode Converter from High to Low Radius Ratio Structures; IEEE Xplore; Oct. 2-7, 2011, pp. 1-2.

* cited by examiner

*Primary Examiner* — Benny Lee
*Assistant Examiner* — Jorge Salazar, Jr.
(74) *Attorney, Agent, or Firm* — Rosenberg, Klein & Lee

(57) ABSTRACT

A multi-channel mode converter operating with a series of TE or TM mode electromagnetic wave includes a plurality of coaxial waveguides arranged in overlay configuration. By controlling radius ratio and the number of coupling aperture of each coaxial waveguide, high power and high purity of operating mode of electromagnetic wave can be obtained and the major parasitic mode of electromagnetic wave can be suppressed, so as to avoid crosstalk between coaxial waveguides. A rotary joint including the above-mentioned mode converter with multi-channel is also disclosed.

26 Claims, 5 Drawing Sheets

MULTI-CHANNEL MODE CONVERTER AND ROTARY JOINT OPERATING WITH A SERIES OF TE OR TM MODE ELECTROMAGNETIC WAVE

The present application claims priority to foreign patent application TW 10110559 filed on Mar. 27, 2012.

BACKGROUND OF THE INVENTION

1. Field of the Invention

The present invention relates to a mode converter and rotary joint of microwave, and more particularly to a multi-channel mode converter and rotary joint operating with a series of TE or TM mode electromagnetic wave.

2. Description of the Prior Art

Mode converters can transform a mode of electromagnetic wave to another mode of electromagnetic wave. For example, when using rotary joints for radar system and satellite system, mode converters can transform communication electromagnetic wave from general transmission mode to another mode which exempts from rotating influence or transform back without energy loss. As to dual channel mode converters, conventionally, two different modes of electromagnetic wave are used for operation and different mode converters must be designed accordingly, which makes the structure of the dual channel mode converter more complicated and limits the channel number. Besides, TEM mode electromagnetic wave is required in outer channels for operating conventional multi-channel converters, and TEM electromagnetic wave leads to heavy energy loss.

To solve the problems mentioned above, a multi-channel mode converter and rotary joint should be developed.

SUMMARY OF THE INVENTION

The present invention is directed to a multi-channel mode converter and rotary converter operating with a series of TE or TM mode electromagnetic wave, wherein a plurality of coaxial waveguides are sleeved to each other and each of them respectively induces electromagnetic wave in proper mode to obtain high power and high purity electromagnetic wave and prevent crosstalk between each coaxial waveguide.

According to an embodiment, the multi-channel mode converter operating with a series of TE or TM mode electromagnetic wave comprises a waveguide element. The waveguide element comprises a first mode converting structure and a second mode converting structure. The first mode converting structure comprises a first waveguide and N first rectangular waveguides, wherein N is a positive integer greater than 1. The first waveguide has a circular outer interface and a first circular port, which forms a first output/input port of the first mode converting structure. A first port of the N first rectangular waveguides is respectively connected to the outer interface of the first waveguide and arranged uniform radially. A long edge of the first port of the N first rectangular waveguides is parallel to a first axis of the first waveguide. A second port of the N first rectangular waveguides forms at least one second output/input port of the first mode converting structure. The second mode converting structure comprises a second waveguide and M second rectangular waveguides, wherein M is a positive integer greater than 1 and equal to $2^n$ and any two adjacent of the M second rectangular waveguides converge into a Y-shaped or T-shaped structure and n is a positive integer equal to or greater than 3. The second waveguide has an outer interface and an inner interface which are circular and arranged coaxially. The second waveguide has a second circular port, which forms a third output/input port of the first mode converting structure. The first waveguide is sleeved into the second waveguide. A third port of the M second rectangular waveguides is respectively connected to the outer interface of the second waveguide and arranged uniform radially. A long edge of the third port of the second rectangular waveguide is parallel to a second axis of the second waveguide. A fourth port of the M second rectangular waveguides forms at least one fourth output/input port of the second mode converting structure.

According to another embodiment, the multi-channel mode rotary joint operating with a series of TE or TM mode electromagnetic wave comprises two aforementioned waveguide elements. The first and second waveguide elements are arranged coaxially as the first output/input port of the first mode converting structure and the second output/input port of the second mode converting structure in opposition and rotatable relatively to each other.

The objective, technologies, features and advantages of the present invention will become more apparent from the following description in conjunction with the accompanying drawings, wherein certain embodiments of the present invention are set forth by way of illustration and examples.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

The detail description is provided below and the preferred embodiments described are only for the purpose of description rather than for limiting the present invention.

When using rotary joint for operation, electromagnetic wave must exempt from rotating influence and conforms to circular symmetry of electromagnetic field, for example, $TE_{01}$ mode electromagnetic wave with properties of torodial surface current. Radius $r_o$ and $r_i$ of outer conductors and inner conductors of coaxial structures can be changed to obtain extra freedoms to adjust and perform electromagnetic wave separation. However, it is a severe challenge to transform coaxial $TE_{01}$ mode electromagnetic wave with high purity because low order parasitic mode wave may increase dramatically with decreasing radius ratio to cause harmful mode competition. In multi-channel system, electromagnetic wave under low order parasitic mode wave may further cause crosstalk between channels.

Cutoff frequency of coaxial $TE_{mn}$ mode electromagnetic wave can be founded by deriving the characteristic value $x_{mn}$ from the equation (1) to find the boundary in the system's frequency response.

$$J_m'(x_{mn})Y_m'(x_{mn}r_i/r_o)-J_m'(x_{mn}r_i/r_o)Y_m'(x_{mn})=0 \quad (1)$$

Figure 1:
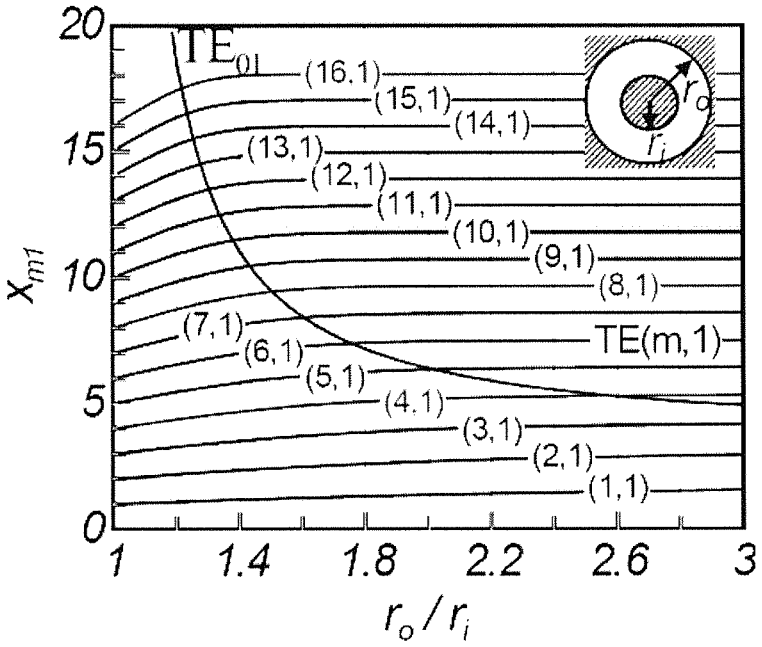
FIG. 1 is a graph illustrating the correlation between the radius ratio of the coaxial waveguides and the cutoff frequency of the $TE_{m1}$ mode electromagnetic wave.

Wherein, $J_m'$ and $Y_m'$ are firth derivatives of the first kind and second kind of Bessel functions. When the radius $r_o$ of outer conductor is much greater than the radius $r_i$ of the inner conductor, $Y_m'(x_{mn}r_i/r_o)$ approaches infinity, and equation (1) can be simplified as $J_m'(x_{mn})=0$, which can determine the cutoff frequency of the circular waveguide. Referring to FIG. 1, when the radius ratio $r_o/r_i$ decreases (i.e. $r_i$ approaches $r_o$), cutoff frequency of coaxial $TE_{mn}$ mode electromagnetic wave ($m\neq0$, $n=1$) also declines. Furthermore, cutoff frequency of coaxial $TE_{01}$ mode electromagnetic wave approaches infinity when $r_i$ approaches $r_o$. By this way, $TE_{01}$ mode electromagnetic wave with larger cross-sectional dimension is allowed to be stimulated in coaxial waveguides.

Figure 4:
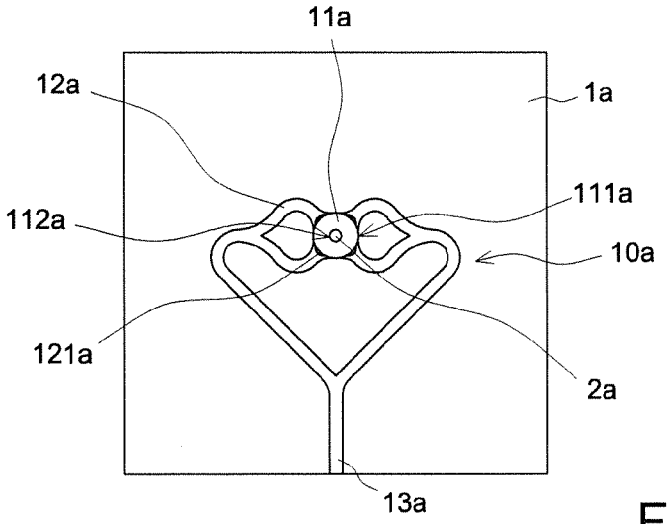
FIG. 4 is a schematic diagram illustrating the first mode converting structure of the multi-channel mode converter operating with a series of TE or TM mode electromagnetic wave multimedia player device according to an embodiment of the present invention.
Figure 5:
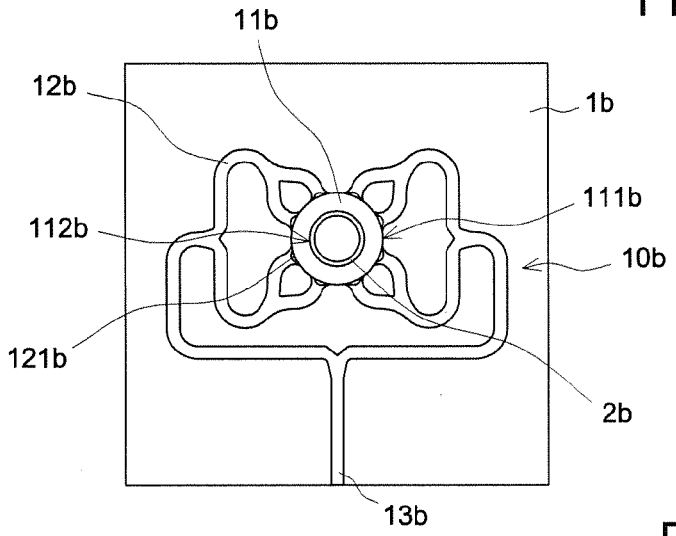
FIG. 5 is a schematic diagram illustrating the second mode converting structure of the multi-channel mode converter operating with a series of TE or TM mode electromagnetic wave multimedia player device according to an embodiment of the present invention.
Figure 6:
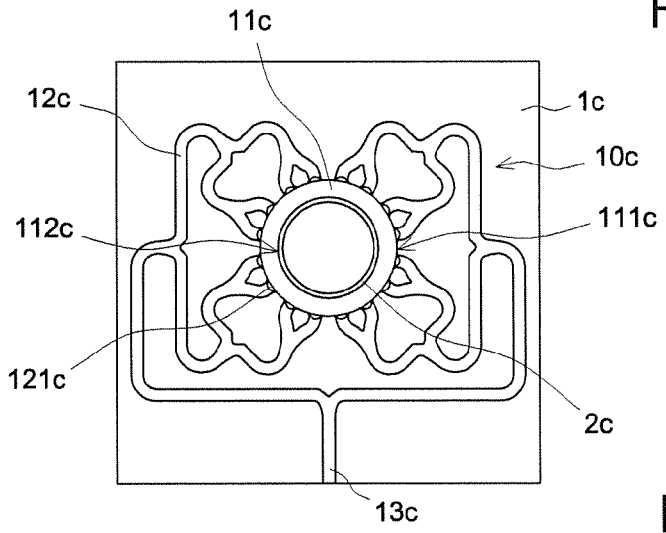
FIG. 6 is a schematic diagram illustrating the third mode converting structure of the multi-channel mode converter operating with a series of TE or TM mode electromagnetic wave multimedia player device according to an embodiment of the present invention.

According to an embodiment of the present invention, the multi-channel mode converter operating with a series of TE or TM mode electromagnetic wave comprises a waveguide element. The waveguide element can be one piece device or composed of multiple devices. Referring to FIG. 4 to FIG. 6, for example, waveguide elements comprise multiple conductive bulk components 1*a*, 1*b* and 1*c*, cylinder component 2*a* and hollow cylinder components 2*b* and 2*c*. To make the description concise and better understood, FIG. 2 and FIG. 3 only illustrates the waveguide structure of the waveguide element.

Referring to FIG. 2 to FIG. 6, the waveguide element comprises a first mode converting structure 10*a* and a second mode converting structure 10*b*. Preferably, the waveguide element further comprises a third mode converting structure 10*c*. Each mode converter is separated to form multiple channels.

The first mode converting structure 10*a* comprises a first waveguide 11*a* and N first rectangular waveguides 12*a*, wherein N is a positive integer greater than 1. The first waveguide 11*a* has an outer interface 111*a* and an inner interface 112*a* which are circular and coaxially arranged. In other words, the first waveguide 11*a* is a coaxial waveguide. A first port of the N first rectangular waveguides is respectively connected to the outer surface 111*a* of the first waveguide and the long edge of the first port is parallel to a first axis of the first waveguide 11*a*. Besides, The N first rectangular waveguides 12*a* are uniform radially arranged around the first waveguide 11*a*. A second port of the N first rectangular waveguides forms at least one first output/input port 13*a* of the first mode converting structure 10*a*. A first circular port of the first waveguide 11*a* forms a first output/input port 14*a* of the first mode converting structure 10*a*.

The second mode converting structure 10*b* comprises a second waveguide 11*b* and M second rectangular waveguides 12*b*, wherein M is a positive integer greater than 1. Similarly, the second wave guide 11*b* has an outer interface 111*b* and an inner interface 112*b* which are circular and arranged coaxially. The first waveguide 11*a* is sleeved into the second waveguide 11*b*. It could be understood that the inner interface 112*b* of the second waveguide 11*b* is larger than the outer interface 111*a* of the first waveguide 11*a*. A third port of the M second rectangular waveguides 12*b* is respectively connected to the outer interface 11*b* of the second waveguide 11*b* and the long edge of the third port is parallel to a second axis of the second waveguide 11*b*. Besides, the M second rectangular waveguides 12 surround the second waveguide 11*b* uniform radially. A fourth port of the M second rectangular waveguides 12*b* forms at least one fourth output/input port 14*b* of the second mode converting structure 10*b*. A second circular port of the second waveguide 11*b* forms a third output/input port 14*b* of the second mode converting structure 10*b*.

The third mode converting structure 10*c* comprises a third waveguide 11*c* and L third rectangular waveguides 12*c*, wherein L is a positive integer greater than 1. Similarly, the third waveguide 11*c* has an outer interface 111*c* and an inner interface 112*c* which are circular and coaxially arranged, and the second waveguide 11*b* is sleeved into the third waveguide 11*c*. A fifth port of the L third rectangular waveguides 12*c* is respectively connected to the outer interface 111*c* of the third waveguide 11*c* and the long edge of the fifth port is parallel to a third axis of the third waveguide 11*c*. Besides, the L third rectangular waveguides 12*c* surround the third waveguide 11*c* uniform radially. A sixth port of the L second rectangular waveguides 12*c* forms at least sixth first output/input port 13*c* of the third mode converting structure 10*c*. A third circular port of the third waveguide 11*c* forms a fifth output/input port 14*c* of the third mode converting structure 10*c*.

According to an embodiment, the first port of the first rectangular waveguide 12*a*, the second rectangular waveguide 12*b* and the third rectangular waveguide 12*c* can be tetragonal symmetry in shape. In one embodiment, the waveguide element can comprises at least one plate conductor (not shown in the figure) which covers the first port of at least one of the first rectangular waveguide 12*a*, the second rectangular waveguide 12*b* and the third rectangular waveguide 12*c*, and the plate conductor has at least one coupling aperture which is column shaped and tetragonal symmetry. The long axis of the coupling aperture is axially parallel to the first waveguide 11*a*, the second waveguide 11*b* and the third waveguide 11*c*. Other coupling structures which can stimulate mode electromagnetic wave while operating shall fall with the spirit and the scope of the present invention.

According to an embodiment, all of the second ports of the plurality of the first rectangular waveguides 12*a* can converge into a single port, which is the second output/input port 13*a* of the first mode converting structure 10*a*. Similarly, all of the fourth ports of the plurality of the second rectangular waveguides 12*b* and all of the sixth ports of the plurality of the third rectangular waveguides 12*c* can respectively converge into a single port, which are the fourth output/input port 13*b* of the second mode converting structure 10*b* and the sixth output/input port 13*c* of the third mode converting structure 10*c*.

Take the first mode converting structure 10*a* for example. A mode electromagnetic wave is provided at the N first waveguides 12*a* around the first waveguides 11*a*, wherein the electrical field direction is axially orthogonal to the first waveguide 11*a*, for example but not limited to $TE_{10}$ mode. Therefore, the electrical field direction of the electromagnetic wave provided at the first rectangular waveguides 12*a* which uniformly surround the first waveguide 11*a* deflects clockwise or counterclockwise; energy and phase of each electromagnetic wave provided at the first rectangular waveguide 12*a* is the same, thereby stimulating $TE_{01}$ mode electromagnetic wave with circle electrical field at the first waveguide 11*a*.

In order to generate electromagnetic wave with equal energy and phase, the number N of the first rectangular waveguide 12*a* is equal to $2^n$, wherein n is a positive integer greater than or equal to 2. Besides, every two adjacent of the first rectangular waveguides 12*a* gradually converge into a Y-shaped or T-shaped structure and finally converge into a single port, i.e. the second output/input port 13*a*. Accordingly, each Y-shaped or T-shaped structure can be an energy splitter, which allows the single input port to generate electromagnetic waves with equal energy and phase at multiple output ports. In an embodiment, the number M of the second rectangular waveguides 12*b* is equal to $2^n$, wherein the n is a positive integer greater than or equal to 3; the number L of the third rectangular waveguide 12*c* is equal to $2^n$, wherein the n is a positive integer greater than or equal to 4.

Figure 3:
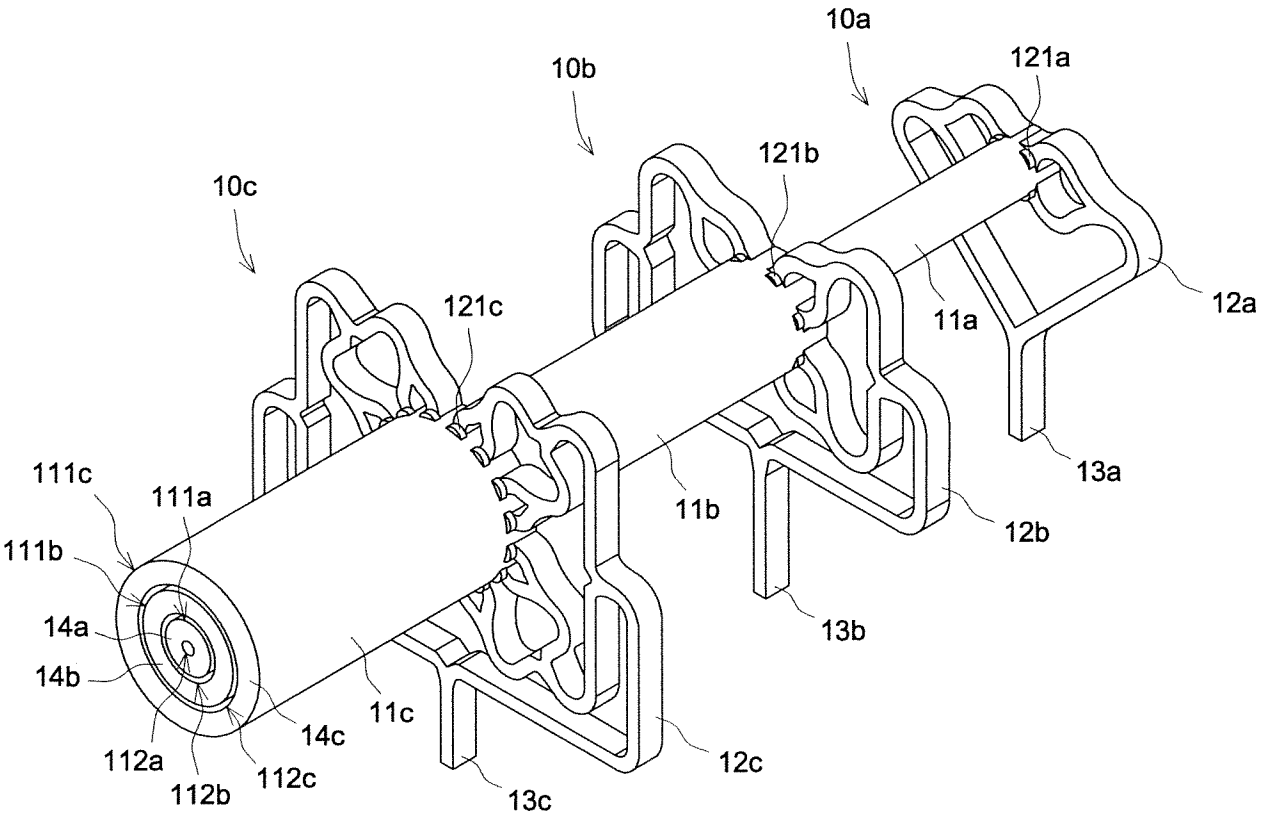
FIG. 3 is a schematic diagram illustrating the waveguide structure of the multi-channel mode converter operating with a series of TE or TM mode electromagnetic wave from another direction according to an embodiment of the present invention.

Referring to FIG. 3, each of the first rectangular waveguides 12*a* faces the first output/input port 14*a* of the first mode converting structure 10*a* to axially extend an arc protrusion 121*a* at the first port of the first rectangular waveguide 12*a*. The arc protrusion 121*a* can mitigate rough surface due to connection between the first rectangular waveguide 12*a* and the first waveguide 11*a*, to reduce reflection and improve transforming efficiency. Similarly, each of the second rectangular waveguides 12*b* faces the third output/input port 14*b* of the second mode converting structure 10*b* to axially extend an arc protrusion 121*b* at the third port of the second rectangular waveguide 12*b*; and each of the third rectangular waveguides 12*c* faces the fifth output/input port 14*c* of the third mode converting structure 10*c* to axially extend an arc protrusion 121*c* at the fifth port of the third rectangular waveguide 12*c*.

As known, azimuthal component presents as $\Gamma=m+jN$, wherein N is the number of electromagnetic waves entering the coaxial waveguides, that is the number of the rectangular waveguides 12*a*, 12*b* and 12*c*, j=0, ±1, ±2, . . . . For the $TE_{01}$ mode electromagnetic wave, m=0, so that $\Gamma$=0, ±4, ±8 . . . . Take the first mode converting structure 10*a* for example. When frequency is higher than the cutoff frequency, $TE_{01}$, $TE_{41}$, $TE_{81}$ . . . mode electromagnetic waves are stimulated correspondingly. As shown in FIG. 1, when the radius ratio $r_o/r_i$ of the coaxial waveguides of the first mode converting structure 10*a* is greater than 2.58, stimulation of major competition mode electromagnetic wave ($TE_{41}$ mode) can be suppressed. Similarly, when the radius ratio $r_o/r_i$ of the coaxial waveguides of the second mode converting structure 10*b* is greater than 1.5, stimulation of major competition mode electromagnetic wave ($TE_{81}$ mode) can be suppressed. As to the major competition mode of the third mode converting structure 10*c* ($TE_{16,1}$), the cutoff frequency of the electromagnetic wave is 118.8 GHz, which is much higher than W-band (75 GHz~110 GHz), so that parasitic oscillations will not happen for the third mode converting structure 10*c*.

Figure 7:
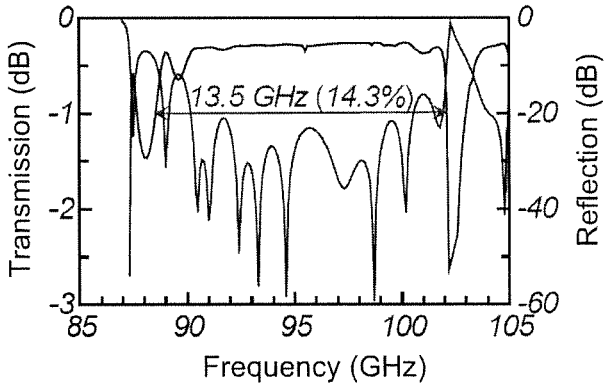
FIG. 7 is a graph illustrating the simulation results of the first mode converting structure of the multi-channel mode converter operating with a series of TE mode electromagnetic wave multimedia player device according to an embodiment of the present invention.

In one embodiment, the radius of the outer interface 111*a* of the first waveguide 11*a* of the first mode converting structure 10*a* is 2.43 mm and 0.60 mm is for the inner interface 112*a*; the radius ratio $r_o/r_i$ is 4.05. Simulation results by using the software, High Frequency Structure Simulator (HFSS), which is developed by Ansoft, are demonstrated in FIG. 7. $TE_{01}$ mode electromagnetic wave with high purity (>99.9%) can be obtained via the first mode converting structure 10*a*, wherein the −1 dB transmission bandwidth is generated from 88 GHz to 102 GHz (14.9%).

Figure 8:
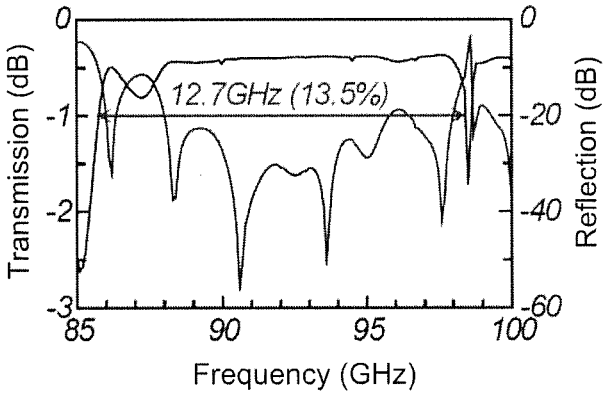
FIG. 8 is a graph illustrating the simulation results of the second mode converting structure of the multi-channel mode converter operating with a series of TE mode electromagnetic wave multimedia player device according to an embodiment of the present invention.

The radius of the outer interface 111*b* of the second waveguide 11*b* of the second mode converting structure 10*b* is 4.60 mm and 2.80 mm is for the inner interface; the radius ratio $r_o/r_i$ is 1.64. Simulation results are demonstrated in FIG. 8. $TE_{01}$ mode electromagnetic wave with 99.9% purity can be obtained via the second mode converting structure 101), wherein the −1 dB transmission bandwidth is generated from 86 GHz to 98 GHz (12.7%).

Figure 9:
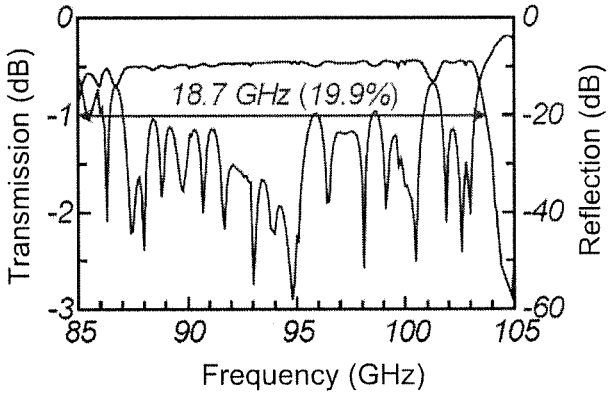
FIG. 9 is a graph illustrating the simulation results of the third mode converting structure of the multi-channel mode converter operating with a series of TE mode electromagnetic wave multimedia player device according to an embodiment of the present invention.

The radius of the outer interface 111*c* of the third waveguide 11*c* of the third mode converting structure 10*c* is 7.20 mm and 5.30 mm is for the inner interface; the radius ratio $r_o/r_i$ is 1.36. Simulation results are demonstrated in FIG. 9. The −1 dB transmission bandwidth is generated from 85 GHz to 104 GHz.

It should be noticed that the innermost layer, i.e. the first waveguide 11*a*, is described in the form of coaxial waveguide, but not limited to this. People who are skilled in art shall understand that the first waveguide 11*a* also can be a circle waveguide, that is to say, even though there is no inner interface 112*a*, the multi-channel mode converter operating with a series of TE or TM mode electromagnetic wave of the present invention still can be fulfilled.

Figure 2:
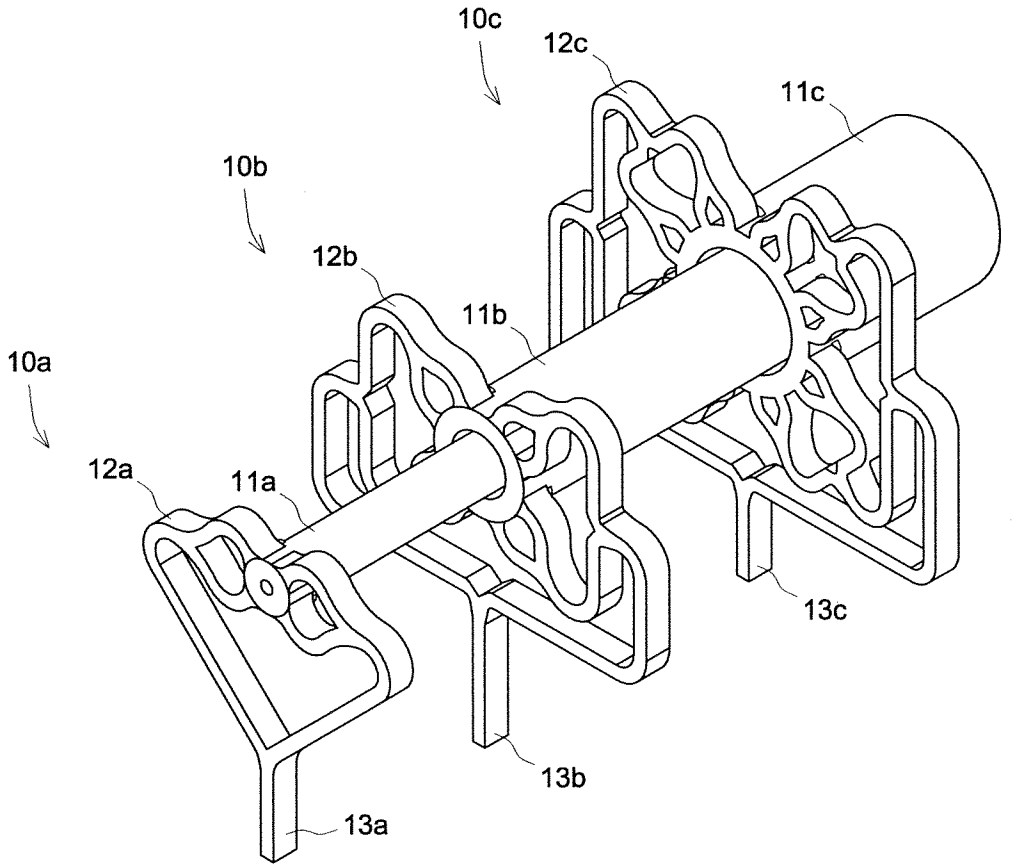
FIG. 2 is a schematic diagram illustrating the waveguide structure of the multi-channel mode converter operating with a series of TE or TM mode electromagnetic wave according to an embodiment of the present invention.

Referring to FIG. 2 and FIG. 3, the multi-channel mode rotary joint operating with a series of TE or TM mode electromagnetic wave according to an embodiment of the present invention comprises two waveguide elements. Structure of the waveguide elements is described before and will not be elaborated any longer. The second output/input port 14*a*, 14*b* and 14*c* of the first mode converting structure 10*a*, the second mode converting structure 10*b* and the third mode converting structure 10*c* are arranged oppositely and coaxially. Accordingly, $TE_{01}$ mode electromagnetic wave stimulated by mode converter of any transmitting channel is not influenced by mutual rotation of two waveguide elements and oscillation direction of the $TE_{01}$ mode electromagnetic wave is axially parallel to the coaxial waveguides. Thus, energy of the $TE_{01}$ mode electromagnetic wave will not escape from the space between two waveguide elements to interfere other channels and further prevents crosstalk between channels.

It should be noticed that $TE_{01}$ mode electromagnetic wave is used while operating in aforementioned embodiments, but not limited to this. People who are skilled in art shall understand that other TE modes or TM series mode electromagnetic waves also can be used while operating. For example, by properly designing the spacing structure between two waveguide elements to form a choke type rotary joint, energy of radial direction can be decreased and further reduces crosstalk between channels.

In conclusion, the present invention relates to a multi-channel mode converter and rotary joint operating with a series of TE or TM mode electromagnetic wave, wherein a plurality of coaxial waveguides are sleeved to each other. By controlling radius ratio of each coaxial waveguide and the number of the coupling apertures, high power and high purity electromagnetic wave can be obtained and major competition mode electromagnetic waves can be suppressed, which prevents crosstalk between each coaxial waveguide.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A multi-channel mode converter operating with a series of TE or TM mode electromagnetic wave comprising a waveguide element, wherein the waveguide element comprises:

a first mode converting structure, which comprises:

a first waveguide having a circular outer interface and a first circular port, which forms a first output/input port of the first mode converting structure; and N first rectangular waveguides, wherein a first port of the N first rectangular waveguides is respectively connected to the circular outer interface of the first waveguide and arranged uniform radially; a long edge of the first port of the N first rectangular waveguides is parallel to a first axis of the first waveguide; and a second port of the N first rectangular waveguides forms at least one second output/input port of the first mode converting structure, wherein N is a positive integer greater than 1; and a second mode converting structure, which comprises:

a second waveguide having an outer interface and an inner interface which are circular and coaxially-arranged, and having a second circular port which forms a third output/input port of the second mode converting structure, wherein the first waveguide is sleeved into the second waveguide; and M second rectangular waveguides, wherein a third port of the M second rectangular waveguides is respectively connected to the outer interface of the second waveguide and arranged uniform radially; a long edge of the third port of the M second rectangular waveguides is parallel to a second axis of the second waveguide; and a fourth port of the M second rectangular waveguides forms at least one fourth output/input port of the second mode converting structure, wherein M is a positive integer greater than 1 and equal to $2^n$ and any two adjacent of the M second rectangular waveguides converge into a Y-shaped or T-shaped structure and n is a positive integer equal to or greater than 3.

2. The multi-channel mode converter operating with a series of TE or TM mode electromagnetic wave according to claim 1, wherein the first waveguide further comprises a circular inner interface arranged coaxially with the circular outer interface of the first waveguide.

3. The multi-channel mode converter operating with a series of TE or TM mode electromagnetic wave according to claim 1, wherein all of the second ports of the N first rectangular waveguides converge into a single port, which is the second output/input port of the first mode converting structure.

4. The multi-channel mode converter operating with a series of TE or TM mode electromagnetic wave according to claim 1, wherein all of the fourth ports of the M second rectangular waveguides converge into a single port, which is the fourth output/input port of the second mode converting structure.

5. The multi-channel mode converter operating with a series of TE or TM mode electromagnetic wave according to claim 1, wherein N is equal to $2^n$ and any two adjacent of the N first rectangular waveguides converge into a Y-shaped or T-shaped structure and n is a positive integer equal to or greater than 2.

6. The multi-channel mode converter operating with a series of TE or TM mode electromagnetic wave according to claim 1, wherein the first output/input port of the first mode converting structure and/or the third output/input port of the second mode converting structure are used to receive or output a electromagnetic wave with properties of toroidal surface current.

7. The multi-channel mode converter operating with a series of TE or TM mode electromagnetic wave according to claim 1, wherein each of the N first rectangular waveguides faces the first output/input port of the first mode converting structure to axially extend an arc protrusion at the first port of the N first rectangular waveguides.

8. The multi-channel mode converter operating with a series of TE or TM mode electromagnetic wave according to claim 1, wherein each of the M second rectangular waveguides faces the third output/input port of the second mode converting structure to axially extend an arc protrusion at the third port of the M second rectangular waveguides.

9. The multi-channel mode converter operating with a series of TE or TM mode electromagnetic wave according to claim 1, wherein the first port of the N first rectangular waveguides and/or the third port of the M second rectangular waveguides are tetragonal symmetry in shape.

10. The multi-channel mode converter operating with a series of TE or TM mode electromagnetic wave according to claim 1, wherein the electromagnetic wave comprises TE01 mode electromagnetic wave.

11. The multi-channel mode converter operating with a series of TE or TM mode electromagnetic wave according to claim 1, wherein the waveguide element further comprises:

a third mode converting structure, which comprises:

a third waveguide having an outer interface and an inner interface which are circular and coaxially-arranged, and having a third circular port which forms a fifth output/input port of the third mode converting structure, wherein the second waveguide is sleeved into the third waveguide; and L third rectangular waveguides, wherein a fifth port of the L third rectangular waveguides is respectively connected to the outer interface of the third waveguide and is arranged uniform radially; a long edge of the fifth port of the L third rectangular waveguides is parallel to a third axis of the third waveguide; and a sixth port of the L second rectangular waveguides forms at least one sixth output/input port of the third mode converting structure, wherein L is a positive integer greater than 1.

12. The multi-channel mode converter operating with a series of TE or TM mode electromagnetic wave according to claim 11, wherein all of the sixth ports of the L third rectangular waveguides converge into a single port, which is the sixth output/input port of the third mode converting structure.

13. The multi-channel mode converter operating with a series of TE or TM mode electromagnetic wave according to claim 11, wherein L is equal to $2^n$ and any two adjacent of the L third rectangular waveguides converge into a Y-shaped or T-shaped structure and n is a positive integer equal to or greater than 4.

14. The multi-channel mode converter operating with a series of TE or TM mode electromagnetic wave according to claim 11, wherein each of the L third rectangular waveguides faces the fifth output/input port of the third mode converting structure to axially extend an arc protrusion at the fifth port of the L third rectangular waveguides.

15. A multi-channel rotary joint operating with a series of TE or TM mode electromagnetic wave comprising first and second waveguide elements, wherein each of the first and second waveguide elements comprises:

a first mode converting structure, which comprises:

a first waveguide having a circular outer interface and a first circular port, which forms a first output/input port of the first mode converting structure; and N first rectangular waveguides, wherein a first port of the N first rectangular waveguides is respectively connected to the circular outer interface of the first waveguide and arranged uniform radially; a long edge of the first port of the N first rectangular waveguides is parallel to a first axis of the first waveguide; and a second port of the N first rectangular waveguides forms at least one second output/input port of the first mode converting structure, wherein N is a positive integer greater than 1; and a second mode converting structure, which comprises:

a second waveguide having an outer interface and an inner interface which are circular and coaxially-arranged, and having a second circular port which forms a third output/input port of the second mode converting structure, wherein the first waveguide is sleeved into the second waveguide; and M second rectangular waveguides, wherein a third port of the M second rectangular waveguides is respectively connected to the outer interface of the second waveguide and arranged uniform radially; a long edge of the third port of the M second rectangular waveguides is parallel to a second axis of the second waveguide; and a fourth port of the M second rectangular waveguides forms at least one fourth output/input port of the second mode converting structure, wherein M is a positive integer greater than 1 and equal to $2^n$ and any two adjacent of the M second rectangular waveguides converge into a Y-shaped or T-shaped structure and n is a positive integer equal to or greater than 3;

wherein the first and second waveguide elements are coaxially arranged as the first output/input port and the second output/input port are arranged in opposition and rotatable relatively to each other.

16. The multi-channel rotary joint operating with a series of TE or TM mode electromagnetic wave according to claim 15, wherein each of the first and second waveguide elements further comprises:

a third mode converting structure, which comprises:

a third waveguide having an outer interface and an inner interface which are circular and coaxially-arranged, and having a third circular port which forms a fifth output/input port of the third converting structure, wherein the second waveguide is sleeved into the third waveguide; and L third rectangular waveguides, wherein a fifth port of the L third rectangular waveguides is respectively connected to the outer interface of the third waveguide and is arranged uniform radially; a long edge of the fifth port of the L third rectangular waveguides is parallel to a third axis of the third waveguide; a sixth port of the L second rectangular waveguides forms at least one sixth output/input port of the third mode converting structure, wherein L is a positive integer greater than 1.

17. The multi-channel rotary joint operating with a series of TE or TM mode electromagnetic wave according to claim 16, wherein all of the sixth ports of the L rectangular waveguides converge into a single port, which is the sixth output/input port of the third mode converting structure.

18. The multi-channel rotary joint operating with a series of TE or TM mode electromagnetic wave according to claim 16, wherein L is equal to $2^n$ and any two adjacent of the L third rectangular waveguides converge into a Y-shaped or T-shaped structure and n is a positive integer equal to or greater than 4.

19. The multi-channel rotary joint operating with a series of TE or TM mode electromagnetic wave according to claim 16, wherein each of the L third rectangular waveguides faces the fifth output/input port of the third mode converting structure to axially extend an arc protrusion at the fifth port of the L third rectangular waveguides.

20. The multi-channel rotary joint operating with a series of TE or TM mode electromagnetic wave according to claim 15, wherein all of the fourth ports of the M second rectangular waveguides converge into a single port, which is the fourth output/input port of the second mode converting structure.

21. The multi-channel rotary joint operating with a series of TE or TM mode electromagnetic wave according to claim 15, wherein N is equal to 2n and any two adjacent of the N first rectangular waveguides converge into a Y-shaped or T-shaped structure and n is a positive integer equal to or greater than 2.

22. The multi-channel rotary joint operating with a series of TE or TM mode electromagnetic wave according to claim 15, wherein the first waveguide further comprises a circular inner interface arranged coaxially with the circular outer interface of the first waveguide.

23. The multi-channel rotary joint operating with a series of TE or TM mode electromagnetic wave according to claim 15, wherein each of the N first rectangular waveguides faces the first output/input port of the first mode converting structure to axially extend an arc protrusion at the first port of the N first rectangular waveguides.

24. The multi-channel rotary joint operating with a series of TE or TM mode electromagnetic wave according to claim 15, wherein each of the M second rectangular waveguides faces the third output/input port of the second mode converting structure to axially extend an arc protrusion at the third port of the M second rectangular waveguides.

25. The multi-channel rotary joint operating with a series of TE or TM mode electromagnetic wave according to claim 15, wherein the first port of the N first rectangular waveguides and/or the third port of the M second rectangular waveguides are tetragonal symmetry in shape.

26. The multi-channel rotary joint operating with a series of TE or TM mode electromagnetic wave according to claim 15, wherein all of the second ports of the N first rectangular waveguides converge into a single port, which is the second output/input port of the first mode converting structure.

* * * * *